US007690309B1

(12) United States Patent
Kuklinski

(10) Patent No.: US 7,690,309 B1
(45) Date of Patent: Apr. 6, 2010

(54) SUPERCAVITATING VEHICLE CONTROL

(75) Inventor: Robert Kuklinski, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 156 days.

(21) Appl. No.: 12/284,477

(22) Filed: Sep. 19, 2008

(51) Int. Cl.
*F42B 15/22* (2006.01)

(52) U.S. Cl. ..... 102/399; 114/20.1; 114/23

(58) Field of Classification Search ..... 102/399; 114/20.1, 23
See application file for complete search history.

(56) References Cited

U.S. PATENT DOCUMENTS 3,041,992 A * 7/1962 Lee ..... 114/312
3,434,425 A * 3/1969 Critcher ..... 102/399
5,929,370 A * 7/1999 Brown et al. ..... 102/399
5,955,698 A * 9/1999 Harkins et al. ..... 102/399
6,684,801 B1 * 2/2004 Kuklinski ..... 114/67 A
6,739,266 B1 * 5/2004 Castano et al. ..... 102/399

* cited by examiner

*Primary Examiner*—J. Woodrow Eldred
*Assistant Examiner*—Gabriel J Klein
(74) *Attorney, Agent, or Firm*—James M. Kasischke; Michael P. Stanley; Jean-Paul A. Nasser

(57) ABSTRACT

A control system for a supercavitating vehicle includes a set of winglets for rapid maneuverability and a segmented ring wing for fine stabilization control. The winglets and ring wing extend from an aft portion of the vehicle. The winglets are supported by a strut attached to the vehicle. The angle of attack of each winglet into the water adjacent the cavity is controlled by a winglet actuator. The winglet assembly may be extended into the water or retracted to be completely within the cavity by means of a spring-loaded actuated mount. The segmented ring wing is controlled by a ring actuator. The ring actuator may be used to control the angle of attack of the ring wing. Alternately, or in combination, the flow over the ring wing may be neutralized by using the cavitator of the vehicle to globally enlarge the cavity and thus limit the flow.

15 Claims, 2 Drawing Sheets

SUPERCAVITATING VEHICLE CONTROL

STATEMENT OF GOVERNMENT INTEREST

The invention described herein may be manufactured and used by or for the Government of the United States of America for governmental purposes without the payment of any royalties thereon or therefor.

CROSS REFERENCE TO OTHER PATENT APPLICATIONS

Not applicable.

BACKGROUND OF THE INVENTION (1) Field of the Invention

The present invention relates to vehicle control systems and methods and more specifically to systems and methods for controlling a trajectory of a supercavitating vehicle.

(2) Description of the Prior Art

There exists a need for reducing drag in underwater vehicles, such as torpedoes, so as to enhance their speed, reliability and stealthy operation. For a nominally streamlined, fully wetted underwater vehicle, 80% of the overall drag is skin friction drag. The remaining drag is pressure or blockage drag.

Some investigations into reducing the drag of high-speed, underwater vehicles have focused attention on supercavitating underwater vehicles. For supercavitation, sufficient energy is put into the water to vaporize a given volume of water to form a cavity through which the object travels. When a vapor cavity completely encapsulates an underwater object, the process is referred to as supercavitation. Supercavitation allows for the higher speeds to be sustainable by reducing skin friction drag to a great extent at such higher speeds. The conditions for supercavitation are known in the art.

To obtain supercavitation, fluid may be accelerated over a sharp edge of the vehicle so that the pressure in the fluid drops below its vapor pressure after passing the edge. The component resulting in the pressure drop may be referred to herein as a cavitator. The cavitator, generally part of the nose shape of the object, is the only part of the object in constant contact with the water through which the vehicle travels.

However, if the speed of the vehicle is not sufficiently fast, the vapor cavity may collapse about the trailing portions of the vehicle. In such cases, artificial ventilation may be introduced into the cavity, which maintains the cavity beyond the trailing edge of the object.

In a ventilated cavity, i.e., one maintained by vaporous or artificial cavitation, the stability of the cavity interface can be maintained by insuring that the gas within the cavity is moving at same the speed as the vehicle. This reduces instabilities at the air-water interface. As a result the vehicle within the cavity is surrounded by high speed ventilation gas.

For stability and control, current supercavitating vehicles rely on one or more tail fins extending radially from an aft portion of the vehicle. Stability is maintained by tail planing, whereby the tail fin is extended into the air-water interface of the cavity. Control surfaces on the tail fins control the vehicle trajectory.

However, the existing system of aft vehicle control produces considerable parasitic drag. In addition, such systems create continuous low frequency oscillations that result in intermittent banging of the tail surface on the air-water interface. The banging results in structural vibration, which increases the noise emanating from the vehicle and thereby decreases the overall stealth of the vehicle.

What is needed is a system for efficiently controlling a supercavitating vehicle. The system should provide an active damping mechanism such that a vehicle riding in an underwater supercavity needs not tail-plane. The system should reduce both the streamwise drag of the vehicle and the structural vibration induced by tail-planing, thus enhancing the stability of the vehicle, increasing its range and improving its stealth. In addition to stabilizing the vehicle in steady flight, the system should provide for quickly turning the vehicle as well.

SUMMARY OF THE INVENTION

It is therefore a general purpose and primary object of the present invention to provide systems and methods for controlling a supercavitating vehicle.

The object of the present invention is attained by providing a control system for a supercavitating vehicle comprising a set of wetted wings and a segmented ring wing extending from an aft portion of the vehicle. The wetted wings, which may be referred to herein as winglets, are supported by a strut attached to the vehicle. The angle of attack of each winglet is controlled by a winglet actuator. The winglet assembly may be extended into or retracted from the water by means of a spring-loaded actuated mount, which pivots the strut supporting the winglet. When fully retracted, the winglet assembly is contained completely within the cavity.

The segmented ring wing is controlled by one or more ring actuators. The dynamic effects of the ring wing may be neutralized by using the cavitator of the vehicle to globally enlarge the cavity and thus limit the flow over the ring wing. Alternately, or in combination, the ring actuator may be used to control the angle of attack of the ring wing. Thus, fine stabilization control is conducted by the wing ring and rapid maneuverability is obtained by the winglets.

In one embodiment, a system for controlling a trajectory of a supercavitating underwater vehicle, which forms a cavity about itself in underwater travel, comprises a winglet connected to the vehicle. The winglet may be extendable into a flow of water surrounding the cavity and an angle of attack of the winglet may be adjustable to affect maneuverability of the vehicle. The system also comprises a segmented ring wing having at least two segments, each segment being separately extendable into the cavity. An angle of attack of each segment may be adjustable to affect stability of the vehicle within the cavity.

In one variation, a winglet strut may have a first end pivotally connected to the vehicle and the winglet may be pivotally connected to a distal end of the winglet strut. A winglet actuator may be connected to the winglet and the winglet strut. Operation of the winglet actuator may pivot the winglet about the distal end of the winglet strut to adjust the angle of attack of the winglet.

A strut actuator may be connected to the winglet strut and the vehicle. Operation of the strut actuator may pivot the winglet strut about the first end of the winglet strut to extend the winglet into the flow of water. The strut actuator may be biased to pivot the winglet strut about its first end to retract the winglet from the flow of water.

In another variation, ring struts each may have a first end connected to the vehicle and a distal end pivotally connected to one of the segments of the ring wing. Ring actuators each may be connected to one of the ring struts and a corresponding one of the segments. Operation of a ring actuator may pivot the corresponding segment about the distal end of the ring strut to adjust the angle of attack of the corresponding segment in the cavity. Each ring actuator is biased to adjust the angle of attack of the corresponding segment to provide steady lift.

Each of the ring actuators is operable to retract the corresponding segment from the cavity toward the vehicle such that the segment is within the body diameter of the vehicle. Recesses on the vehicle may be shaped to accommodate the segments within the body diameter.

In another variation, a winglet strut may have a first end pivotally connected to the vehicle and the winglet may be pivotally connected to a distal end of the winglet strut. Ring struts each may have a first end connected to the vehicle and a distal end pivotally connected to one of the segments of the ring wing.

A winglet actuator may be connected to the winglet and the winglet strut such that operation of the winglet actuator may pivot the winglet about the distal end of the winglet strut to adjust the angle of attack of the winglet. Ring actuators each may be connected to one of the ring struts and a corresponding one of the segments such that operation of a ring actuator may pivot the corresponding segment about the distal end of the ring strut to adjust the angle of attack of the corresponding segment in the cavity.

A strut actuator may be connected to the winglet strut and the vehicle such that operation of the strut actuator may pivot the winglet strut about its first end so as to extend the winglet in the flow of water. The strut actuator may be biased to pivot the winglet strut about its first end so as to retract the winglet from the flow of water.

Each of the ring actuators may be biased to adjust the angle of attack of the corresponding segment to provide steady lift; and each of the ring actuators may be operable to retract the corresponding segment from the cavity toward the vehicle such that the segment is within the body diameter of the vehicle. Recesses on the vehicle may be shaped to accommodate the segments within the body diameter of the vehicle.

BRIEF DESCRIPTION OF THE DRAWINGS

A more complete understanding of the invention and many of the attendant advantages thereto will be readily appreciated as the same becomes better understood by reference to the following detailed description when considered in conjunction with the accompanying drawings wherein.

DESCRIPTION OF THE INVENTION

Figure 1:
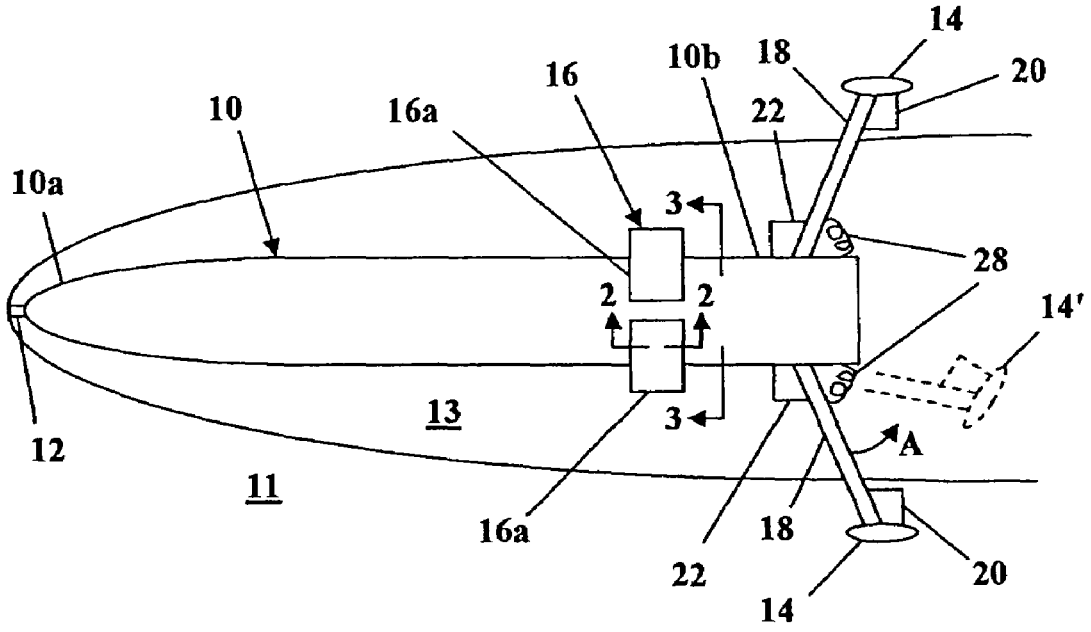
FIG. 1 shows a side view of an underwater, supercavitating vehicle with the control system of the present invention.

Referring now to FIG. 1, there is shown a side view of underwater vehicle 10 traversing through a fluid medium 11. For ease of reference, medium 11 is described herein as water. As is known in the art, water 11 is accelerated over a cavitator 12 attached to a nose portion 10*a* of vehicle 10. The downstream pressure drops below the vapor pressure of water 11 after passing cavitator 12, resulting in the formation of cavity 13, through which vehicle 10 traverses.

For stability and control of vehicle 10, winglets 14 and segmented ring wing 16 extend from an aft portion 10*b* of vehicle 10. In the side view of FIG. 1, two winglets 14 and two segments 16*a* of ring wing 16 are illustrated. However, those of skill in the art will recognize that the number of winglets 14 and segments 16*a* can be varied, with the winglets 14 and segments 16*a* being spaced equally about vehicle 10 for maintaining balance. Thus, for balance purposes but not for limitation, at least two winglets 14 and at least two segments 16*a* may be provided. Preferably, four sets of winglets 14 and segments 16*a* maintain balance, while providing an adequate level of control for vehicle 10, as explained further herein. For ease of fabrication, each set of one winglet 14 and one segment 16*a* preferably is aligned longitudinally, with winglet 14 being further aft than segment 16*a*, though other arrangements of components are contemplated.

Each winglet 14 is supported by winglet strut 18, which is pivotally attached to vehicle 10. Both winglet 14 and winglet strut 18 may be hydrodynamically shaped to minimize drag. However, those of skill in the art will recognize that the detailed shape (i.e., chord, span or thickness) of winglet 14 or winglet strut 18 will depend on the particular design conditions for vehicle 10.

When extended away from vehicle 10 by means of pivoting winglet strut 18, as shown in FIG. 1, winglet strut 18 extends through cavity 13 and winglet 14 extends into water 11. The angle of attack of each winglet 14 with respect to the flow of water 11 is controlled by winglet actuator 20. Strut actuator 22 pivots winglet strut 18 about its attachment point to vehicle 10, as indicated by arrow A. Having winglets 14 extend into water 11 provides rapid maneuverability as the angle of attack of winglets 14 is controlled by actuators 20.

Figure 2:
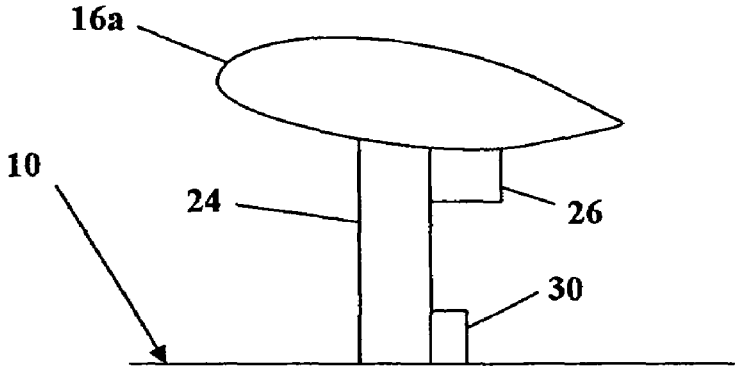
FIG. 2 shows a partial cross-sectional view of a control surface taken at line 2-2 of FIG. 1.

Referring also to FIG. 2, there is shown a partial cross-sectional view of a segment 16*a*, taken at line 2-2 of FIG. 1. Each segment 16*a* of ring wing 16 is supported by ring strut 24. As is the case for winglets 14 and winglet struts 16, both segments 16*a* and ring struts 24 may be hydrodynamically shaped to minimize drag; and those of skill in the art will recognize that their detailed shape (i.e., chord, span or thickness) will depend on the particular design conditions for vehicle 10.

Ring struts 24 may be pivotally connected to segments 16*a*, such that the angle of attack of segments 16*a* into the flow through cavity 13 may be controlled by one or more ring actuators 26. Ring actuators 26 may bias the angle of attack, such that segments 16*a* provide a steady lift to carry the weight of vehicle 10 within cavity 13. Additionally, or in combination, the dynamic effects of ring wing 16 on the shape of cavity 13 may be diminished by using cavitator 12 to enlarge cavity 13 and thus limit the flow effects over ring wing 16. Since segments 16*a* only extend into cavity 13, they have less influence on maneuverability than that afforded by winglets 14. However, segments 16*a* do provide the necessary fine stabilization control to reduce the tail banging associated with current supercavitating vehicles.

Generally, vehicle 10 will be launched underwater from a tube. To facilitate such a launch, both winglets 14 and ring wing 16, together with their respective struts (18 and 24), may be retractable so that vehicle 10 may fit within the launching tube.

For winglets 14, strut actuator 22 may be biased to retract winglet 14 and winglet strut 18. For illustration in FIG. 1, and not limitation, winglet actuator 22 is biased by spring 28. When retracted, as indicated in phantom (14') in FIG. 1, winglet 14 and winglet strut 18 are contained within cavity 13. Additionally, winglets 14 may retracted during periods of steady flight of vehicle 10, i.e., during periods when rapid maneuvering is not required.

For segments 16*a*, ring actuator(s) 26 may be used to retract segments 16*a* and ring struts 24. Alternately, or in combination, retraction actuator 30 may be provided to retract segments 16*a* and ring struts 24. Segments 16*a*, when fully retracted, may be recessed into the body diameter of vehicle 10 to permit the tube launch of vehicle 10. Those of skill in the art will recognize that the amount of recess is a function of the mean thickness of cavity 13 at the axial location of ring wing 16. Extending the thickness of cavity 13 in the location of ring wing 16 will increase the volumetric flow area within cavity 13. As a result, the effectiveness of ring wing 16 in providing stabilization control will decrease. Thus, ring wing 16 may be operated in conjunction with cavitator 12 to produce a desirable cross-section for cavity 13 depending on the particular maneuver desired for vehicle 10.

Figure 3:
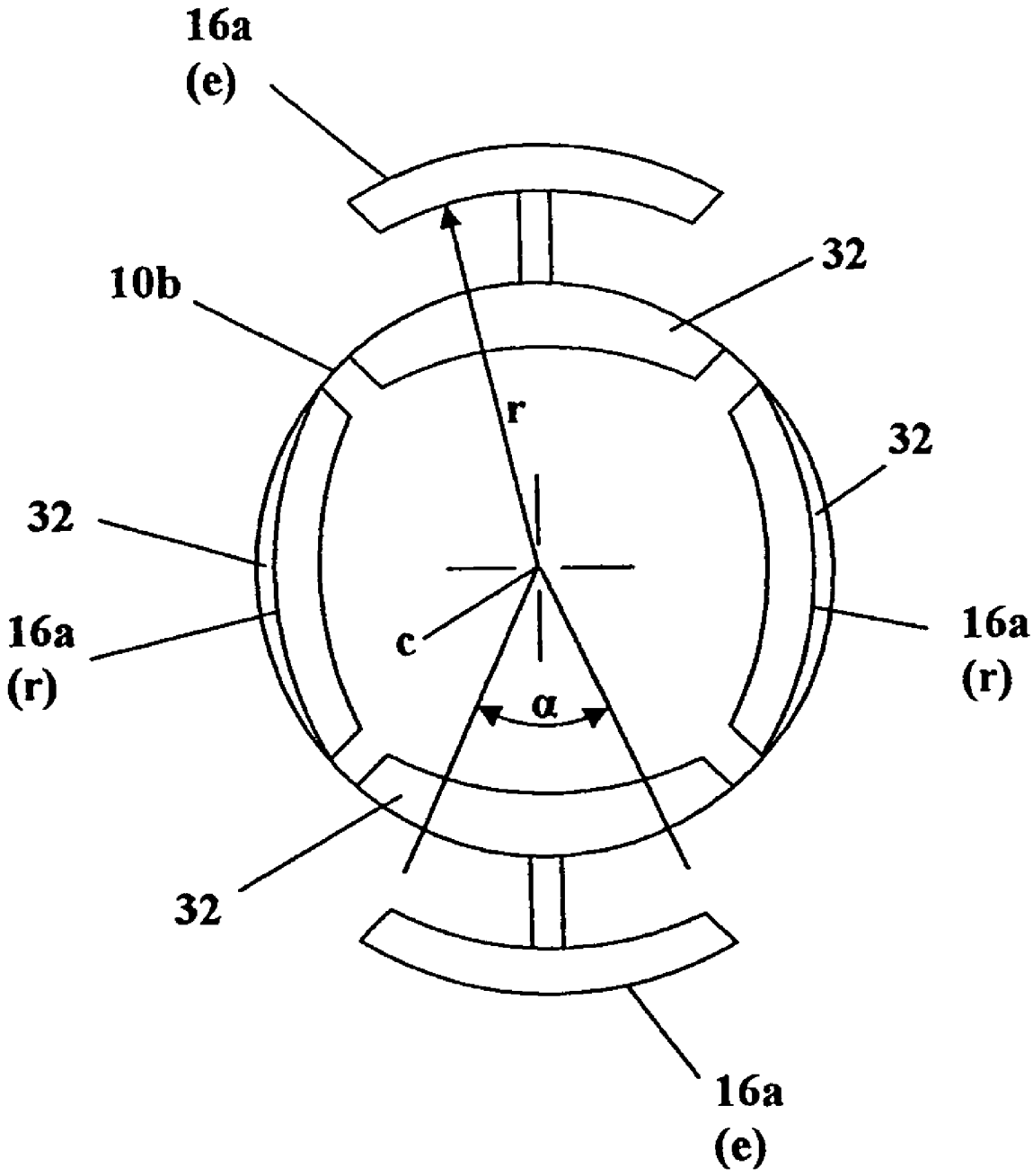
FIG. 3 shows a cross-sectional view of an aft end of the vehicle taken at line 3-3 of FIG. 1.

Referring to FIG. 3, there is illustrated a cross-sectional view of aft portion 10*b* of vehicle 10 taken at line 3-3 of FIG. 1. In FIG. 3, actuators 26 and 30 are not shown for clarity. For illustration, but not for limitation, FIG. 3 shows ring wing 16 having four segments 16*a*, two of which are shown extended (labeled e) and two of which are shown retracted (labeled r). Also for illustration, but not for limitation, vehicle 10 includes recesses 32 into which segments 16*a* may rest when fully retracted such that vehicle 10 may be tube launched, as discussed previously herein.

As shown in FIG. 3, segments 16*a* are arcuate segments of ring wing 16, having a centerpoint, c, coincident with that of vehicle 10, when extended. The radius, r, of segments 16*a* will depend on the extent to which segments 16*a* extend into cavity 13. The included angle, $\alpha$, will depend on the number of segments 16*a* and the extent to which segments 16*a* will be separated when fully retracted. As illustrated in FIG. 3, $\alpha$ is such that segments 16*a* do not overlap when retracted.

What has thus been described is a control system for a supercavitating underwater vehicle that provides enhanced stabilization control and more rapid maneuverability. A set of winglets extends through the cavity and into the water to provide for rapid maneuverability. A segmented ring wing operates within the cavity and provides for fine stabilization control. The angle of attack of the winglets and ring wing may be controlled by actuators. Each winglet is supported by a strut that is pivotally attached to the vehicle. The winglet assembly may be extended into the water or retracted to be completely within the cavity by means of a spring-loaded actuated mount, which pivots the strut about its attachment to the vehicle. The winglets and segmented ring wing may be retracted such that the vehicle may be tube launched.

Thus, the system not only provides maneuverability through the winglets, but the segmented ring wing controls the stability of the vehicle such that low frequency vehicle oscillations of the vehicle are minimized. By so doing, contact with the cavity boundary is avoided and structural vibrations are minimized. Separate controls for maneuverability and stability provide increased flexibility in controlling the flight path of the vehicle.

Obviously many modifications and variations of the present invention may become apparent in light of the above teachings. For example: the system may be mounted at various axial positions along the vehicle; the number of ring wing segments and winglets may be varied to suit the geometry of a particular vehicle; and the detailed shape of the winglets, ring wing or support struts may be varied to suit. Further, the relative positions of the winglets and ring wing as well as the configuration of their support struts may be varied. Additionally, the fine stability control provided by the ring wing and the maneuverability provided by the winglets may be used independently.

It will be understood that many additional changes in details, materials, steps, and arrangements of parts which have been described herein and illustrated in order to explain the nature of the invention, may be made by those skilled in the art within the principle and scope of the invention as expressed in the appended claims.

What is claimed is:

1. A system for controlling a trajectory of a supercavitating underwater vehicle, which forms a cavity about itself in underwater travel, said system comprising:

a winglet connected to said vehicle, said winglet being extendable into a flow of water surrounding the cavity, an angle of attack of said winglet being adjustable to affect maneuverability of the vehicle; and a segmented ring wing having at least two segments, each segment of said ring wing being separately deployable from a first position retracted into said vehicle to a second position extended into the cavity, an angle of attack of each said segment being adjustable to affect stability of the vehicle within the cavity.

2. The system of claim 1 further comprising a winglet strut having a first end pivotally connected to the vehicle and a distal end pivotally connected to said winglet.

3. The system of claim 2 further comprising a winglet actuator connected to said winglet and said winglet strut, operation of said winglet actuator pivoting said winglet about said distal end of said winglet strut to adjust the angle of attack of said winglet.

4. The system of claim 3 further comprising a strut actuator connected to said winglet strut and the vehicle, operation of said strut actuator pivoting said winglet strut about said first end of said winglet strut to extend said winglet in the flow of water.

5. The system of claim 4 wherein said strut actuator is biased to pivot said winglet strut about said first end of said winglet strut to retract said winglet from the flow of water.

6. The system of claim 1 further comprising at least two ring struts each having a first end connected to the vehicle and a distal end pivotally connected to one of said segments of said ring wing.

7. The system of claim 6 further comprising at least two ring actuators, each ring actuator connected to one of said ring struts and a corresponding one of said segments, operation of said ring actuator pivoting said corresponding segment about said distal end of said ring strut to adjust the angle of attack of said corresponding segment in the cavity.

8. The system of claim 7 wherein each of said ring actuators is biased to adjust the angle of attack of said corresponding segment to provide steady lift.

9. The system of claim 8 wherein each of said ring actuators is operable to retract said corresponding segment from the cavity toward the vehicle such that said corresponding segment is within a body diameter of the vehicle.

10. The system of claim 9 wherein the vehicle has recesses formed thereon, each said recess being shaped to accommodate said corresponding segment within the body diameter of the vehicle.

11. The system of claim 1 further comprising:

a winglet strut having a first end pivotally connected to the vehicle and a distal end pivotally connected to said winglet; and at least two ring struts each having a first end connected to the vehicle and a distal end pivotally connected to one of said segments of said ring wing.

12. The system of claim 11, further comprising:

a winglet actuator connected to said winglet and said winglet strut, operation of said winglet actuator pivoting said winglet about said distal end of said winglet strut to adjust the angle of attack of said winglet; and at least two ring actuators, each ring actuator connected to one of said ring struts and a corresponding one of said segments, operation of said ring actuator pivoting said corresponding segment about said distal end of said ring strut to adjust the angle of attack of said corresponding segment in the cavity.

13. The system of claim 12 further comprising a strut actuator connected to said winglet strut and the vehicle, operation of said strut actuator pivoting said winglet strut about said first end of said winglet strut to extend said winglet in the flow of water.

14. The system of claim 13 wherein:

said strut actuator is biased to pivot said winglet strut about said first end of said winglet strut to retract said winglet from the flow of water;

each of said ring actuators is biased to adjust the angle of attack of said corresponding segment to provide steady lift; and each of said ring actuators is operable to retract said corresponding segment from the cavity toward the vehicle such that said corresponding segment is within a body diameter of the vehicle.

15. The system of claim 14 further comprising recesses on the vehicle, each said recess being shaped to accommodate said corresponding segment within the body diameter of the vehicle.

* * * * *